US009105417B2

(12) United States Patent
Weber

(10) Patent No.: US 9,105,417 B2
(45) Date of Patent: Aug. 11, 2015

(54) METHOD FOR CONTROLLING THE OPENING OR CLOSING OF AN ELECTRIC CIRCUIT IN AN ELECTRIC METER

(75) Inventor: Patrick Weber, Rueil Malmaison (FR)

(73) Assignee: SAGECOM ENERGY & TELECOM SAS, Rueil Malmaison (FR)

( * ) Notice: Subject to any disclaimer, the term of this patent is extended or adjusted under 35 U.S.C. 154(b) by 317 days.

(21) Appl. No.: 13/503,810

(22) PCT Filed: Dec. 8, 2010

(86) PCT No.: PCT/EP2010/007461

§ 371 (c)(1),
(2), (4) Date: Apr. 24, 2012

(87) PCT Pub. No.: WO2011/072816

PCT Pub. Date: Jun. 23, 2011

(65) Prior Publication Data

US 2012/0206851 A1 Aug. 16, 2012

(30) Foreign Application Priority Data

Dec. 14, 2009 (FR) ..... 09 06029

(51) Int. Cl.
*H01H 47/18* (2006.01)
*H01H 9/56* (2006.01)

(52) U.S. Cl.
CPC ..... *H01H 9/56* (2013.01)

(58) Field of Classification Search
CPC ..... H01H 9/56
USPC ..... 361/195
See application file for complete search history.

(56) References Cited

U.S. PATENT DOCUMENTS

| | | | | |
|---|---|---|---|---|
| 5,644,463 | A * | 7/1997 | El-Sharkawi et al. | 361/94 |
| 6,392,390 | B1 * | 5/2002 | Ito et al. | 323/209 |
| 2010/0200383 | A1 * | 8/2010 | Saito | 200/33 R |
| 2010/0254060 | A1 * | 10/2010 | Saito et al. | 361/115 |

FOREIGN PATENT DOCUMENTS

| | | | |
|---|---|---|---|
| EP | 0 108 538 | A1 | 5/1984 |
| EP | 2 068 335 | A1 | 6/2009 |
| GB | 423 967 | A | 2/1935 |
| GB | 2 057 207 | A | 3/1981 |

* cited by examiner

*Primary Examiner* — Thienvu Tran
*Assistant Examiner* — Kevin J Comber
(74) *Attorney, Agent, or Firm* — Muncy, Geissler, Olds & Lowe, P.C.

(57) ABSTRACT

A method of controlling the opening or the closing of an AC electric circuit in an electricity meter by means of a relay is provided. The method times relay activation commands so as to take account of the inertial delay (di) of the relay, in such a manner that the actual activation command applied to the relay causes the relay actually to take action on the electric circuit when an electrical parameter of said circuit reaches a zero value, in order to limit the formation of electric arcs in the relay.

15 Claims, 2 Drawing Sheets

METHOD FOR CONTROLLING THE OPENING OR CLOSING OF AN ELECTRIC CIRCUIT IN AN ELECTRIC METER

FIELD OF THE INVENTION

The present invention relates to a method of controlling the opening or the closing of an electric circuit in an electricity meter.

BACKGROUND OF THE INVENTION

Electricity meters are devices that enable the instantaneous consumption of current and the voltage on an electricity line to be measured with metrological precision, so as to enable the exact electricity consumption of electrical equipment to be billed, e.g. in a house. In known manner, such meters include one or more electromechanical type relays that make it possible to open or close the electric circuit passing through the meter, so as to establish or disconnect the supply of electricity to the house in question. It may be necessary to open the circuit as a result of detecting a voltage surge upstream from the meter. It may also be necessary to do so in the event of the user not paying for electricity consumption, with the instruction to activate the relay then coming from outside the meter. The relay is generally controlled by electronic means of the microprocessor type housed in the meter itself. In the same manner, closure of the circuit may be controlled from the outside or by components within the meter itself.

Electromechanical relays are components that are subject to wear, and they present a lifetime that depends on the electrical conditions in which they are activated, while the relay is being opened or closed. It can happen that they are severely stressed in the event of electric arcs being struck in uncontrolled manner while opening or closing a circuit.

Document EP 0 108 538 describes an alternating current (AC) electric circuit that may be closed or opened by means of a relay, said relay being connected to an electronic control unit in order to activate opening or closing of the electric circuit when an electrical parameter of the circuit reaches a zero value. The timing of the closing or opening of the electric circuit takes the inertial delay of the relay into account. Nevertheless, the inertial delay is merely predetermined.

SUMMARY OF THE INVENTION

An object of the invention is thus to devise a method of controlling an electromechanical relay of an electricity meter that enables the relay to have a longer lifetime or indeed to be less severely stressed on being activated for the purpose of closing or opening the electric circuit passing through the meter.

The invention provides a method of controlling the opening or the closing of an AC electric circuit in an electricity meter by activating the opening or closing of a relay. The method times commands for activating the relay in such a manner that the actual command for activating the relay triggers actual action of the relay on the electric circuit at a time when an electrical parameter of said circuit reaches a value that is zero (or quasi-zero), so as to limit the formation of electric arcs in the relay.

According to the invention, the method comprises the following steps:

requesting activation of the relay at a given initial moment (t0);

determining an inertial delay (di) of the relay between an actual order for activating the relay and the relay actually taking action on the electric circuit;

measuring an electrical parameter of the electric circuit until a second moment (t1) is detected at which the parameter reaches a value of zero, after the given initial moment of the request for activation plus the inertial delay of the relay (t0+di); and imparting a time delay on the activation request until the actual order for activating the relay is issued so that actual action of the relay takes place at the second moment (t1).

It has been shown in the context of the invention that the premature wear of relays is due, at least in part, to the presence of electric arcs that form when the relay is activated. The invention thus proposes slightly delaying the actual command for controlling the relay so that the relay becomes active only when the risk of an arc forming is significantly reduced or even eliminated, i.e.:

when the current flowing in the electric circuit is zero (or quasi-zero) when the circuit is to be opened; or when the voltage across the terminals of the relay is zero (or quasi-zero) when the electric circuit is to be closed.

This periodic crossing through a zero value for the voltage or the current of the electric circuit is naturally made possible by the fact that the circuit is an AC circuit.

Furthermore, the timing takes account of the inertial delay of the relay. Each type of relay has a certain amount of inertia in response to a command. It is therefore advantageous for the timing applied by the invention to take account also of this inertial delay so that the relay is actually activated beyond its normal inertial delay and when the electrical parameter has a value that is zero or reaches a zero value.

Thus, taking account of the inertial delay of the relay makes it possible to further reduce the risk of an electric arc forming when the relay opens or closes. This contributes to lengthening the lifetime of the relay.

Advantageously, the step of determining the inertial delay between an order for activating the relay and actual action of the relay on the electric circuit enables the inertial delay of the relay to be calculated on a regular basis.

This step may be performed by taking measurements at the time of a given opening or closing command of the relay of the meter after the meter has been installed. It is also possible to determine the inertial delay of the relay beforehand, i.e. before issuing a command to the relay. The relay may thus be calibrated initially during manufacture of the meter or when the meter is put into service. The step of determining the inertial delay then makes it possible to verify the validity of the inertial delay as stored, or else to correct it.

The method of the invention thus takes account of any degradation that may occur in the performance of the relay, due in particular to the relay aging.

Thus, the risk of an electric arc forming when the relay opens or closes is further reduced. This contributes to lengthening the lifetime of the relay.

As mentioned above, when opening the electric circuit, the measured electrical parameter is the magnitude of the current upstream from the relay. By way of example, the magnitude of the current is measured by a device comprising a resistor of temperature-controlled resistance (also known as a "shunt").

When closing the electric circuit, the measured electrical parameter is the voltage of the electricity across the terminals of the relay. Under such circumstances, and by way of example, the voltage across the terminals of the relay is measured by a device comprising an amplifier and an analog-to-digital converter system.

The order for activating the relay may be given by electronic and/or computer means present in the electricity meter or arranged outside the meter.

The invention may apply to single phase AC.

The invention may also apply to multiphase AC, in particular to three-phase AC.

Under such circumstances, in a first variant, each AC phase is opened or closed by a relay having its own electrical parameter measurement means: the method of the invention is applied separately to each of the phases.

In a second variant, each AC phase is opened or closed by a respective relay, with a first phase in which the electrical parameter is measured, with the zero crossing of the electrical parameter relating to the other phases being determined by taking account of the known phase offsets of the other phases relative to said first phase: the electrical parameter is measured on only one of the phases, with the timing of the other phases being calculated on the basis of the phase on which the electrical parameter is measured. This method is more economic in terms of measurement and just as reliable as the first variant.

In both the first and the second variants, the invention makes it possible to offset relay activations and thus to spread the instantaneous power consumption of the relays, thereby contributing to reducing the dimensioning of the power supply.

The invention also provides an electricity meter including at least one relay connected to an electronic control unit in order to activate the opening or the closing of the associated electric circuit, the electric circuit being provided with voltage and/or current measurement means, said meter implementing the above-described control method.

Other characteristics and advantages of the invention appear on reading the following description of particular, non-limiting embodiments of the invention.

BRIEF DESCRIPTION OF THE DRAWINGS

Reference is made to the accompanying drawings, in which.

DETAILED DESCRIPTION OF THE PREFERRED EMBODIMENTS

Figure 1:
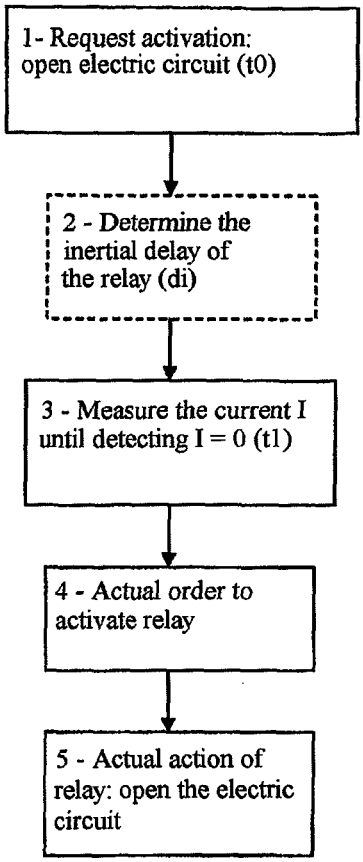
FIG. 1 is a block diagram of the method of the invention for opening an electric circuit of an electricity meter by means of a relay.
Figure 2:
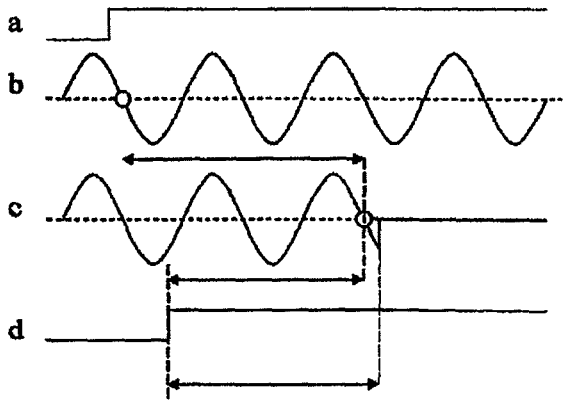
FIG. 2 is a diagram of the current flowing in the electric circuit passing through the meter when the circuit is opened by the method shown in FIG. 1.

FIGS. 1 and 2 explain the method of causing the AC circuit of an electricity meter to be opened by means of an electromechanical relay controlled by a microprocessor housed in the meter itself (it could also be located outside the meter, and be connected to the relay by appropriate connection means). The description below does not give details of the design of the electricity meter, of the relay, or of the microprocessor that controls it, since these elements are themselves known.

The method represented by the block diagram of FIG. 1 serves to cause the circuit to be opened and it comprises the following successive steps:

Step 1: requesting activation (signal a in FIG. 2) of the relay in order to open the electric circuit at an initial time t0. The activation request may originate from the outside (e.g. if the user has not paid a bill for electricity consumption, thereby causing the electric circuit to be opened under the control of a central unit managing the operation of meters remotely). It may also be controlled by a microprocessor housed in the meter, e.g. when a voltage surge is detected.

Step 2: determining the inertial delay di of the relay (where the initial delay is represented by the electrical signal c in FIG. 2). Here it is assumed that, at the time the meter is put into operation, this delay in the response of the relay to an activation signal is known and predetermined (e.g. it was measured in the factory during assembly of the meter). The step of determining the inertial delay makes it possible to define the inertial delay once more so as to correct the initially-determined inertial delay, should that be necessary. The new value of the inertial delay is stored in readiness for a subsequent activation.

Step 3: measuring the magnitude I of the electric current upstream from the relay by means of a resistor of temperature-controlled resistance, also referred to as a "shunt", in order to detect/predict when the current takes on a zero value, after allowing the inertial delay of said relay to elapse. (Alternatively, it is possible to measure the magnitude of the electric current indirectly, by means of the Hall effect or by a current transformer.)

Step 4: effectively activating the relay, activation (signal d in FIG. 2) while taking account both of the inertial delay of the relay and of the time when the current crosses through zero (I=0) after said delay.

Specifically, a time is added that corresponds to an integer number of periods beyond the maximum of the delay of the relay. The opening delay as determined and stored is subtracted from said time in order to generate the actual command order of the relay.

Step 5: actually activating the relay: the relay opens the electric circuit when the magnitude of the current is zero (or almost zero), after its inertial delay—the relay is thus activated at an appropriate moment (circle marked on the electric signal c of FIG. 2) so as to avoid creating electric arcs.

In more detailed manner, the actual opening of the relay, as measured by the absence of current flow is measured by the current measurement unit and then supplied to the control unit. Detection is based on the disappearance of the current other than at the expected zero crossings, thereby avoiding detecting multiple bounces. The control system can thus deduce the real time that elapses between the opening command and the relay actually opening. This value is averaged with the expected opening time and put back into storage for subsequent use. Thus, on the next opening command, the relay control unit can anticipate when to apply the command to the relay more accurately, so that actual opening takes place exactly when the current crosses through zero.

The first measurement of this delay between the command and actual opening is performed during a calibration stage in the factory and is stored in the memory of the processor.

Thus, the actual opening of the circuit takes place at the instant when the current is at its minimum, thereby avoiding producing voltage surge arcs and enabling the lifetime of the relay to be lengthened, and possibly also enabling its size to be reduced.

Figure 3:
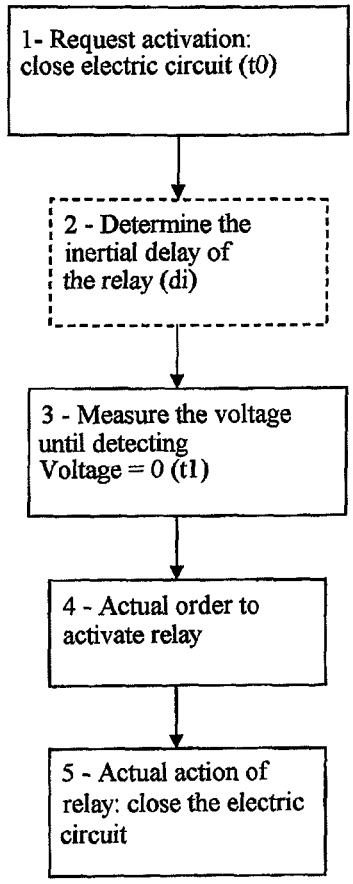
FIG. 3 is a block diagram of the method of the invention for closing the electric circuit of an electricity meter by a relay.

FIG. 3 corresponds to the block diagram for a circuit closure command. There can be seen the same number of steps 1 to 5 as in the opening command. Differences compared with the opening command are as follows:

in step 1, this time naturally relates to a circuit closure command;

in step 3, this time it is the voltage (the potential difference) across the terminals of the relay that is measured by means of an amplifier and an analog-to-digital converter system, until a voltage of value zero is detected. Specifically, voltage measurement is performed across the relay: each of the potentials is measured with the help of an analog-to-digital converter, and then the difference is taken between the results in order to obtain the voltage across the terminals of the relay;

in step 4, this time the actual order is an order to close the relay, and in step 5, the actual action performed by the relay is closure, with this being performed when the voltage is zero or quasi-zero.

The invention is not limited to the embodiments described but covers any variant coming within the ambit of the invention as defined by the claims.

Thus, provision may be made for a time delay that runs from the instant at which the value of the current or the voltage becomes zero, and serves to add some number of periods calculated from this point of the signal prior to the relay actually actuating to close or open the circuit.

When it comes to determining the inertial delay, it is also possible to verify the stored inertial delay and then to check it, e.g. by performing an activation without a time delay. Detecting that the circuit has been opened and closed by the relay is performed by measuring voltage (across the relay) and current, respectively. By way of example, this verification step may be performed when the meter is put into operation and it may be followed by correcting the stored value of the inertial delay as a function of the inertial delay as measured while performing the verification. The inertial delay may also be measured each time the relay(s) is/are activated in order to correct the inertial delay that is stored for use in a subsequent activation. In the event of the relay contacts bouncing, the inertial delay is determined as a function of the first-detected opening or closure.

It is also possible to have a plurality of relays acting on the same electric circuit, each being suitable for being controlled in accordance with the invention independently of the others, particularly if redundancy is preferable in the event of an unwanted failure of one of the relays.

With multiphase AC, it is possible to offset closures (or openings) of the circuits by the relays accurately, thereby contributing to reducing the instantaneous current consumption of the relays, and to reducing the size of the power supply system. In the event of a voltage surge, provision may be made to avoid offsetting circuit opening, and on the contrary to open the circuit(s) as quickly as possible.

The invention is advantageous in that it is implemented by using pre-existing means: thus, electricity meters are generally already fitted with relays controlled by electronic units that may be internal and/or external to the meter, means for detecting voltage surges, and means for measuring electrical parameters of the electricity, including its voltage and its current. The invention thus makes use of means that are already available for the purpose of improving the lifetime of the relay without modifying the structure of the meter nor making its mode of operation significantly more complicated.

What is claimed is:

1. A method of controlling the opening or the closing of an AC electric circuit in an electricity meter by using a relay, the method timing commands for activating the relay so that the actual command for activating the relay triggers actual action of the relay on the electric circuit at a time when an electrical parameter of said circuit reaches a value that is zero, so as to limit the formation of electric arcs in the relay, wherein the method comprises the following steps:

requesting activation of the relay at a given initial moment (t0);

collecting a stored inertial delay (di) of the relay between an actual order for activating the relay and the relay actually taking action on the electric circuit for determining said inertial delay (di), the stored inertial delay being determined by initial calibration of the relay and being checked and corrected by performing an activation without a time delay when the electricity meter is put into operation;

measuring an electrical parameter of the electric circuit until a second moment (t1) is detected at which the parameter reaches a value of zero, after the given initial moment of the request for activation plus the inertial delay of the relay (t0+di); and imparting a time delay on the activation request until the actual order for activating the relay is issued so that actual action of the relay takes place at the second moment (t1).

2. The control method according to claim 1, wherein it relates to opening the electric circuit, and wherein the measured electrical parameter is the magnitude (I) of the current upstream from the relay.

3. The method according to claim 1, wherein the magnitude of the current is measured by a device comprising a resistor of temperature-controlled resistance.

4. The control method according to claim 1, wherein it relates to closing the electric circuit, and wherein the measured electrical parameter is the voltage (U) of the electricity across the terminals of the relay.

5. The control method according to claim 4, wherein the voltage across the terminals of the relay is measured by a device comprising an amplifier and an analog-to-digital converter system.

6. The control method according to claim 1, wherein the order for activating the relay is given by electronic and/or computer means present in the electricity meter or arranged outside the meter.

7. The control method according to claim 1, wherein the electricity is single phase AC.

8. The control method according to claim 1, wherein the electricity is multiphase AC, in particular three-phase AC.

9. The control method according to claim 8, wherein each AC phase is opened or closed by a relay having its own electrical parameter measurement means.

10. The control method according to claim 8, wherein each AC phase is opened or closed by a respective relay, with a first phase in which the electrical parameter is measured, with the zero crossing of the electrical parameter relating to the other phases being determined by taking account of the known phase offsets of the other phases relative to said first phase.

11. An electricity meter including at least one relay connected to an electronic control unit in order to activate the opening or the closing of the associated electric circuit, the electric circuit being provided with voltage and/or current measurement means, said meter implementing the method according to claim 1.

12. A method of controlling the opening or the closing of an AC electric circuit in an electricity meter by using a relay, the method timing commands for activating the relay so that the actual command for activating the relay triggers actual action of the relay on the electric circuit at a time when an electrical parameter of said circuit reaches a value that is zero, so as to limit the formation of electric arcs in the relay, wherein the method comprises the following steps:

requesting activation of the relay at a given initial moment (t0);

collecting a stored inertial delay (di) of the relay between an actual order for activating the relay and the relay actually taking action on the electric circuit for determining said inertial delay (di), the stored inertial delay being determined, when the electricity meter is put into operation, by initial calibration of the relay and being checked and corrected by performing an activation without a time delay;

measuring an electrical parameter of the electric circuit until a second moment (t1) is detected at which the parameter reaches a value of zero, after the given initial moment of the request for activation plus the stored inertial delay of the relay (t0+di);

imparting a time delay on the activation request until the actual order for activating the relay is issued so that actual action of the relay takes place at the second moment (t1); and measuring the real inertial delay during the activation of the relay in order to correct the stored inertial delay for use in a subsequent activation.

13. An electricity meter including at least one relay connected to an electronic control unit in order to activate the opening or the closing of the associated electric circuit, the electric circuit being provided with voltage and/or current measurement means, said meter implementing the method according to claim 12.

14. A method of controlling the opening or the closing of an AC electric circuit in an electricity meter by using a relay, the method timing commands for activating the relay so that the actual command for activating the relay triggers actual action of the relay on the electric circuit at a time when an electrical parameter of said circuit reaches a value that is zero, so as to limit the formation of electric arcs in the relay, wherein the method comprises the following steps:

requesting activation of the relay at a given initial moment (t0);

collecting a stored inertial delay (di) of the relay between an actual order for activating the relay and the relay actually taking action on the electric circuit for determining said inertial delay (di);

measuring an electrical parameter of the electric circuit until a second moment (t1) is detected at which the parameter reaches a value of zero, after the given initial moment of the request for activation plus the stored inertial delay of the relay (t0+di);

imparting a time delay on the activation request until the actual order for activating the relay is issued so that actual action of the relay takes place at the second moment (t1); and measuring the real inertial delay during the activation of the relay in order to correct the stored inertial delay for use in a subsequent activation, the correction being made by averaging the stored inertial delay with the measured real inertial delay and putting back the average value into storage for subsequent activation.

15. An electricity meter including at least one relay connected to an electronic control unit in order to activate the opening or the closing of the associated electric circuit, the electric circuit being provided with voltage and/or current measurement means, said meter implementing the method according to claim 14.

* * * * *